US005427244A

United States Patent [19]

Ikeguchi

[11] Patent Number: 5,427,244

[45] Date of Patent: Jun. 27, 1995

[54] PACKING DEVICE

[76] Inventor: Shigetaka Ikeguchi, 364 Aza-kitadamen, Oaza-kitaishiki, Saya-cho, Ama-gun, Aichi-ken, Japan

[21] Appl. No.: 140,742

[22] Filed: Oct. 22, 1993

[30] Foreign Application Priority Data

| | | | |
|---|---|---|---|
| Dec. 28, 1992 | [JP] | Japan | 4-359803 |
| Feb. 22, 1993 | [JP] | Japan | 5-057896 |
| Feb. 22, 1993 | [JP] | Japan | 5-057897 |
| Sep. 9, 1993 | [JP] | Japan | 5-249851 |

[51] Int. Cl.[6] ..... B65D 73/00

[52] U.S. Cl. ..... 206/457; 206/521; 206/525

[58] Field of Search ..... 206/457, 521, 521.1, 206/523, 525; 426/111; 446/487, 486, 310

[56] References Cited

U.S. PATENT DOCUMENTS

| | | | |
|---|---|---|---|
| 503,387 | 8/1893 | Schofield | 446/487 |
| 4,027,064 | 5/1977 | Bussey, Jr. | 206/523 |
| 4,448,309 | 5/1984 | Roccaforte et al. | 426/111 |
| 4,599,269 | 7/1986 | Kohaut et al. | 206/523 |
| 5,090,569 | 2/1992 | Nissen et al. | 206/457 |
| 5,533,131 | 4/1925 | Muller | 206/457 |

*Primary Examiner*—David T. Fidei
*Attorney, Agent, or Firm*—Armstrong, Westerman, Hattori, McLeland & Naughton

[57] ABSTRACT

A packing device made of a soft sheet material including a raised center seat portion on which a bottom of an object to be packed can be placed, a reversibly deformable intermediate portion which diagonally extends from the center seat portion to define the raised center seat portion, so that when the center seat portion is depressed, the deformable intermediate portion can be reversibly deformed in the opposite direction, and a holding portion comprised of a plurality of holding arms which integrally extend from the deformable intermediate portion in the radial directions thereof.

10 Claims, 10 Drawing Sheets

PACKING DEVICE

BACKGROUND OF THE INVENTION

1. Field of the Invention

The present invention relates to a packing device which is used in packing an object, and more precisely, it relates to a packing device made of a soft sheet material which can softly pack or wrap an object or article, etc., to be packed.

2. Description of Related Art

There are known various packing materials which are used to softly and entirely cover or wrap fruits, ornaments, daily necessaries, precision products or various mechanical elements, etc., to thereby protect the same from shock or prevent the same from being damaged particularly at outer surfaces thereof.

For example, a net bag which is made of soft foamed synthetic resin has been used to wrap a fruit such as a peach or melon. The net bags are continuously formed by cutting a blank net which is in turn formed by a special extrusion mold process at a predetermined length.

However, it is necessary to use a large, complex and expensive extrusion molding machine in order to make the net bags, and hence this increases the manufacturing cost of the net bags. On the other hand, a user must troublesomely open the inlet openings of the individual net bags to put or insert the fruits in the net bags through the openings. Moreover, the net bags are usually folded when they are stocked or transported, but nevertheless, the net bags are bulky and accordingly inconvenient for stock and transport.

SUMMARY OF THE INVENTION

The primary object of the present invention is to provide a simple and inexpensive sheet-like packing device.

Another object of the present invention is to provide a packing device which enables a user to easily wrap an article or product, etc.

Still another object of the present invention is to provide a compact packing device which is in the form of a sheet, so that the packing sheets can be laminated, thus resulting in a reduced space for stock.

According to the present invention, there is provided a packing device which is made of a soft sheet material whose base material is made of foamed synthetic resin, comprising a raised center seat portion on which a bottom of an object to be packed can be placed, a reversibly deformable intermediate portion which diagonally extends from the center seat portion to define the raised center seat portion, so that when the center seat portion is depressed, the deformable intermediate portion can be reversibly deformed in the opposite direction, and a holding portion comprised of a plurality of holding arms which integrally extend from the deformable intermediate portion in the radial directions thereof.

Preferably, the center seat portion is in the form of a generally circular plate.

It is possible to provide a reinforcing rib or reinforcing ribs on the center seat portion and/or the reversibly deformable intermediate portion.

Provision is made to an annular thin portion between the raised center seat portion and the reversibly deformable intermediate portion, so that the deformable intermediate portion can be easily bent at the annular thin portion to cause a reverse deformation thereof.

In a preferred embodiment, the holding arms are curved into a concave shape.

The holding arms can be provided with reinforcing elongate ribs extending in longitudinal directions thereof.

To enhance the flexibility of the holding arms, it is possible to provide elongate openings or ribs extending in longitudinal directions thereof.

According to another aspect of the present invention, a packing device made of a soft sheet material comprises a raised center seat portion on which an object to be packed can be put, an intermediate inclined portion integrally extending from the center seat portion to surround the latter, said intermediate inclined portion being reversibly deformed in the opposite direction to come into a closed position when the center seat portion is depressed by an external force, and a petal-like holding arms extending from the intermediate inclined portion in the radial directions, so that when the intermediate inclined portion is in the closed position, the holding arms are substantially closed to surround the object placed on the center seat portion.

BRIEF DESCRIPTION OF THE DRAWINGS

The invention will be described below in detail with reference to the accompanying drawings, in which.

DESCRIPTION OF THE PREFERRED EMBODIMENT

Figure 1:
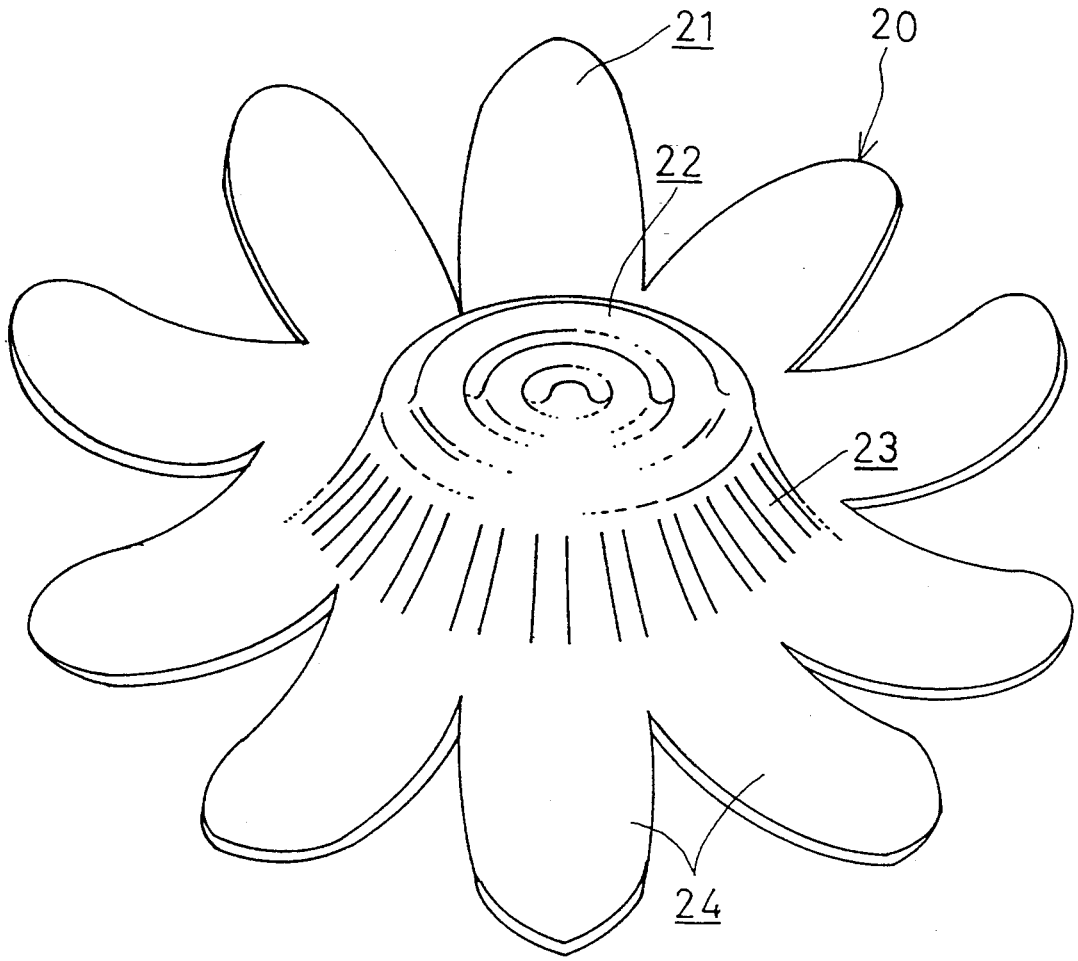
FIG. 1 is a perspective view of a packing device according to the present invention.
Figure 2:
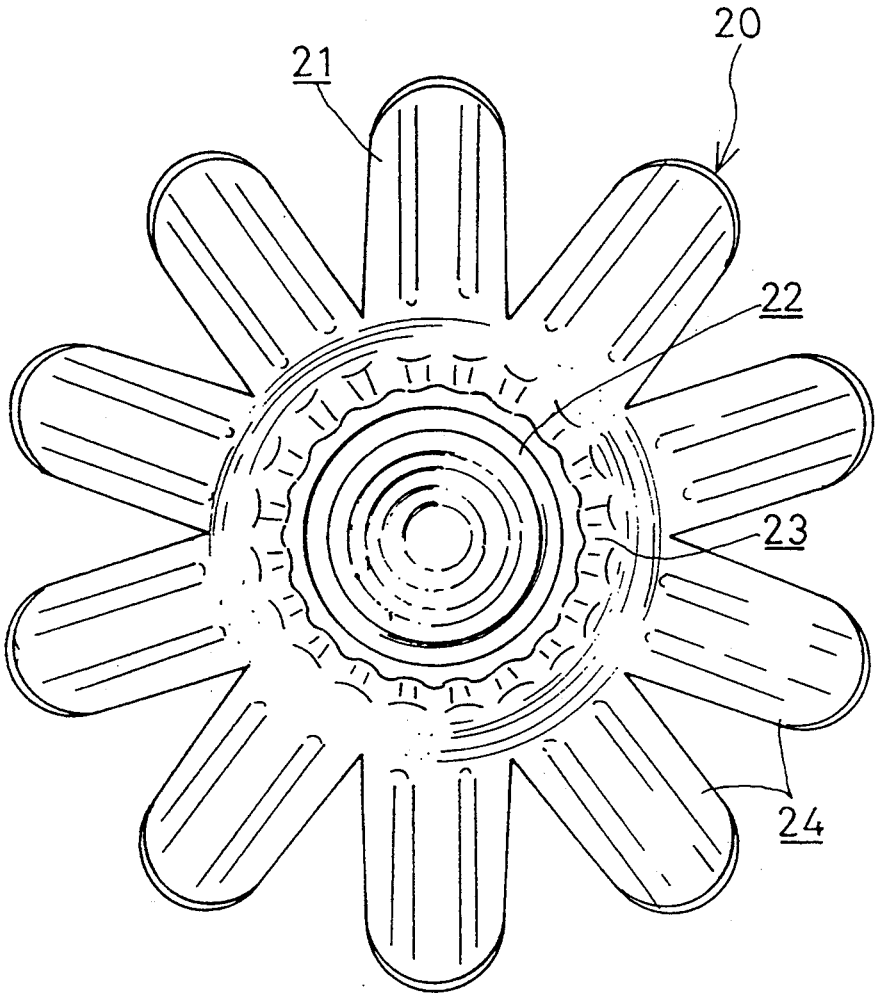
FIG. 2 is a plan view of a packing device shown in FIG. 1.
Figure 3:
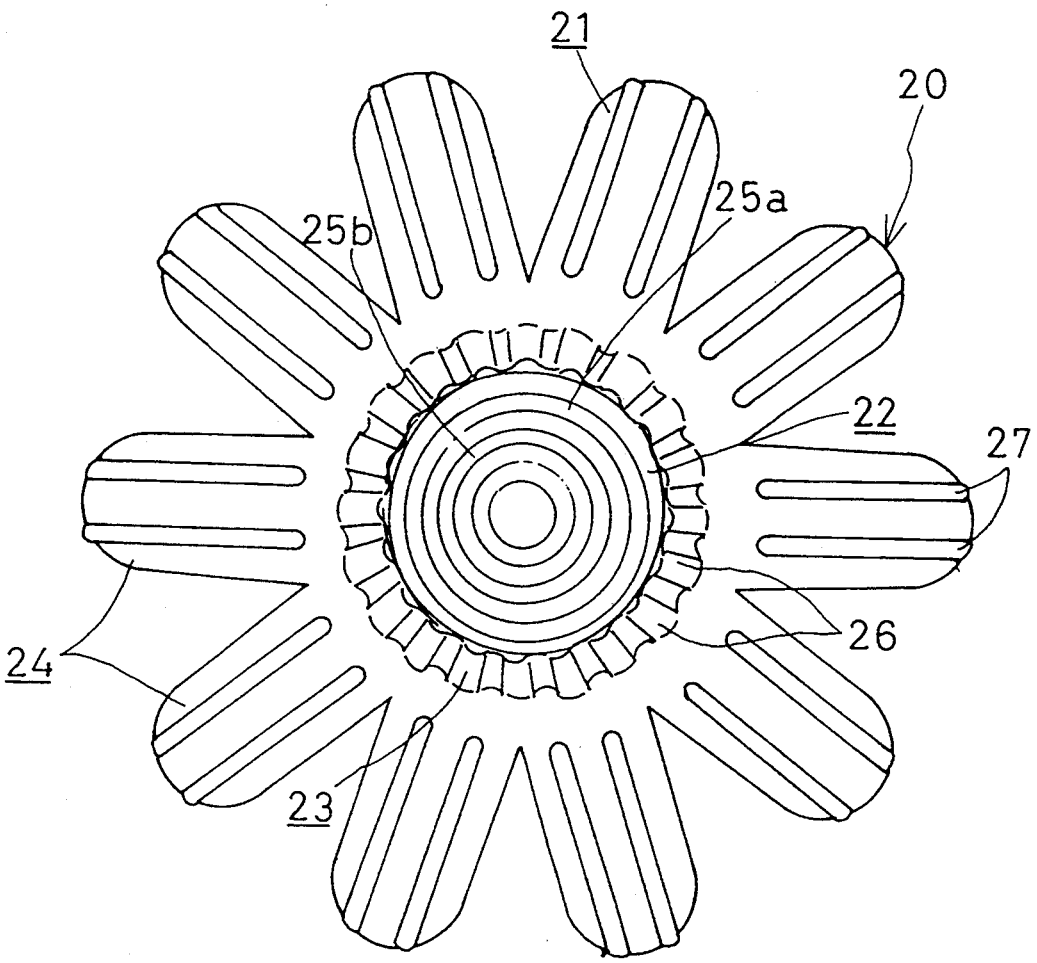
FIG. 3 is a bottom view of a packing device shown in FIG. 1.

As can be seen in FIGS. 1 through 5, a packing device 20 according to the present invention is made of a soft sheet material 21 whose base material is made of foamed synthetic resin. The packing device 20 is essentially comprised of a raised center seat portion 22, a curved or inclined deformable intermediate portion 23 integral with the center seat portion 22, and a holding portion 24 integral with the deformable portion 23. The deformable intermediate portion 23 which is integrally connected to the center seat portion 22 to surround the same is inclined or curved downward with respect to the center seat portion 22 to define the raised center seat portion 22 and is reversibly deformable in the reverse or opposite direction, as will be discussed below. The holding portion 24 is comprised of a plurality of holding arms which are in the form of petals integrally extending from the deformable intermediate portion 23 in the radial directions.

The soft sheet material 21 of which the packing device 20 is made is preferably a soft sheet material with which an object to be packed or wrapped, such as fruits can be softly wrapped without being damaged at the outer surface thereof. For example, as the base material of the sheet material can be advantageously used a foamed synthetic resin material including polyethylene, polypropylene, polystyrene, or polyurethane, etc. It is possible to use a composite laminated sheet composed of a foamed synthetic resin sheet and other foamed or non-foaming sheet or net material adhered thereto.

The center seat portion 22 is substantially at the center of the packing device 20, so that the bottom of the object to be packed can be placed on the center seat portion 22. In the illustrated embodiment, the center seat portion 22 is in the form of a substantially circular disc, but the shape of the center seat portion 22 is not limited thereto. For instance, the center seat portion 22 can be generally elliptical, triangular, rectangular (including square), polygonal, etc.

The center seat portion 22 is provided on the bottom thereof with ribs 25*a*, 25*b* which contributes not only to a reinforcement of the packing device 20 but also to a shock absorption and maintenance of a hot or cold temperature of the object to be packed. Preferably, the reinforcing ribs 25*a* and 25*b* are in a concentrical arrangement.

The reversible inclined portion (deformable intermediate portion) 23 which defines the raised center seat portion 22 extend downward and outwardly from the center seat portion 22 and is smoothly inclined with respect to the latter, so that when the center seat portion 22 is pressed downward, the reversible inclined portion 23 is elastically deformed and reversed in the opposite direction. In the illustrated embodiment, the center seat portion 22 and the reversible inclined portion 23 generally define a dome shape. The center seat portion 22 is depressed as indicated at an arrow D in FIG. 5, for example when the object to be packed is put on the center seat portion 22 and pressed downward by an external force.

Figure 5:
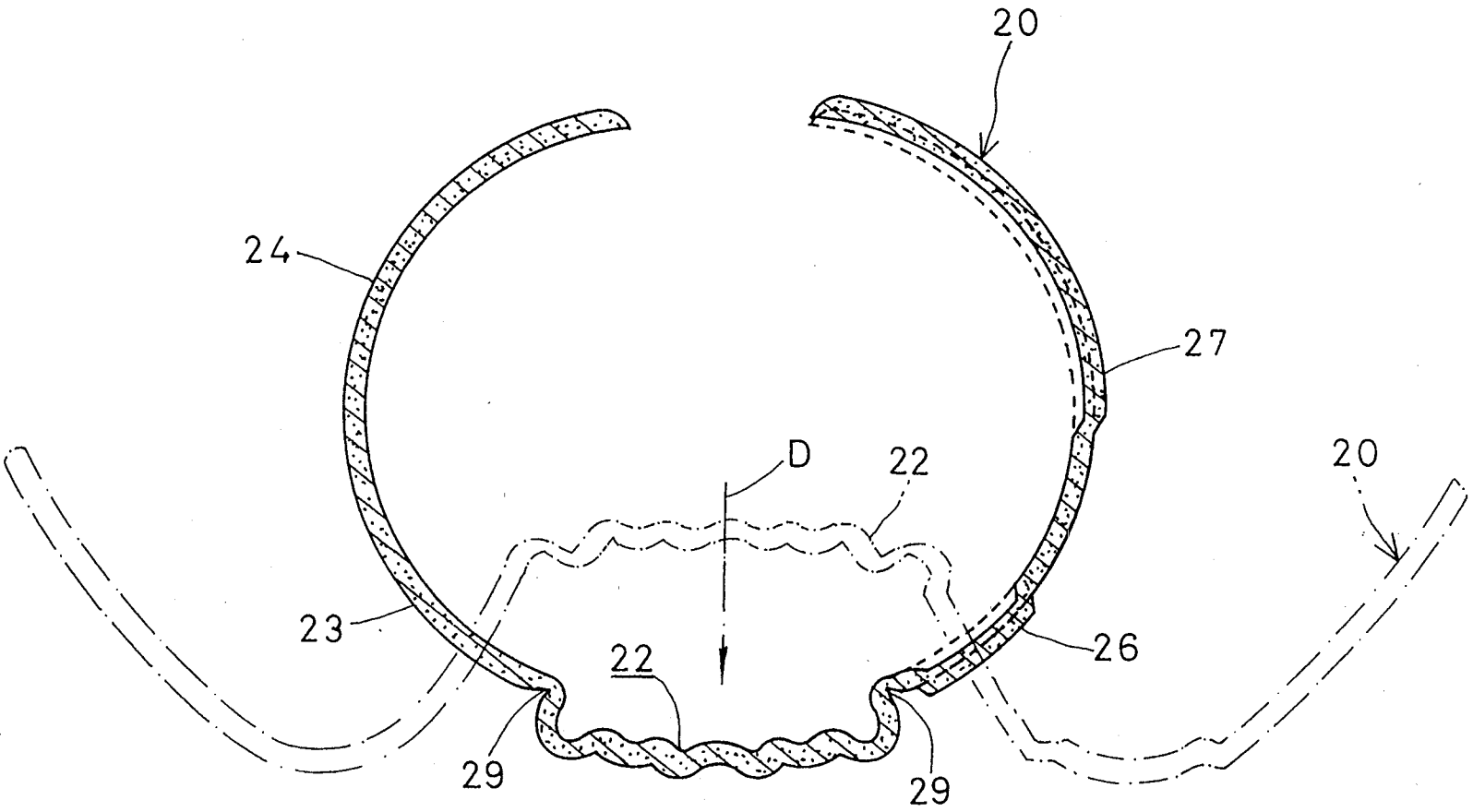
FIG. 5 is an enlarged central sectional view similar to FIG. 4, but shown in a packing position in which the packing device is deformed in the opposite direction.

Preferably, the deformable intermediate portion 23 is provided thereon with one or a plurality of radially extending elongate rib(s) 26 along the deformable intermediate portion. The elongate rib(s) 26 increase(s) the stiffness of the deformable intermediate portion 23 and ensure(s) the reverse deformation of the deformable intermediate portion 23 in the inward direction when an external force above a predetermined value is applied to the center seat portion 22. As a result of the reverse deformation of the deformable intermediate portion 23 which has been in the original open position as indicated at a phantom line in FIG. 5, the deformable intermediate portion 23 comes to a holding position as indicated by a solid line in which the deformable intermediate portion 23 and the holding arms 22 define a generally circular shape in section. In addition to the reinforcement effect, the radially extending rib(s) enhance(s) the shock absorbability and contributes to a maintenance of a constant temperature of the object to be packed particularly at the lower end portion of the object to be packed when the packing device 20 is in the holding position (closed or packed position) as shown in FIG. 5.

Figure 4:
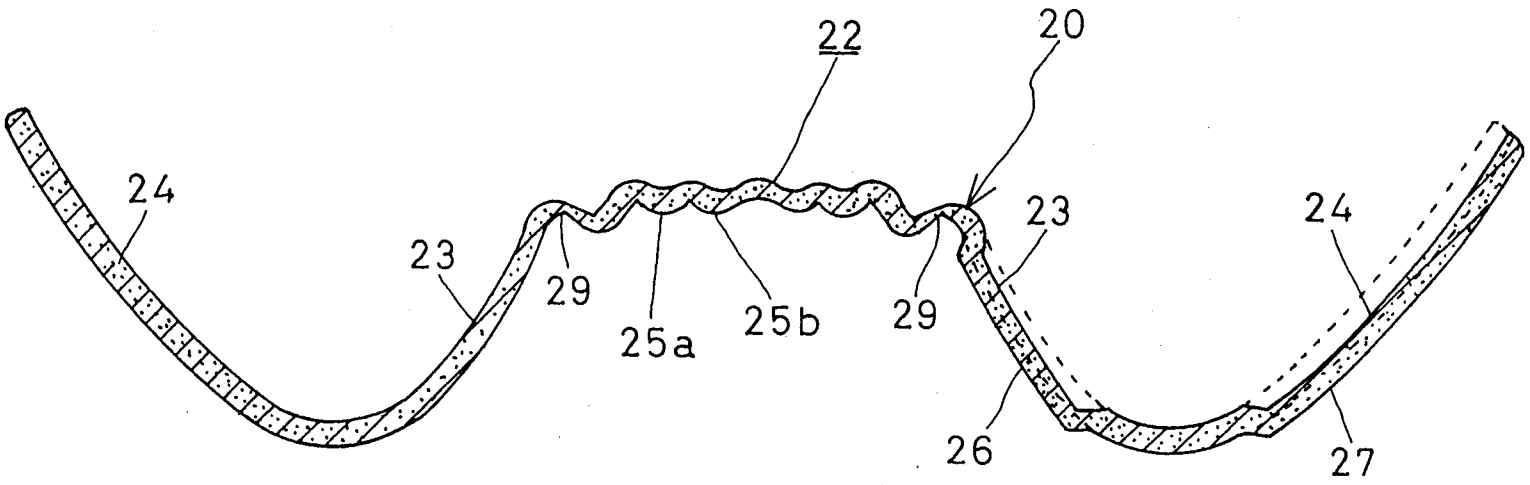
FIG. 4 is an enlarged central sectional view of a packing device shown in FIG. 1.

To ensure that the inward deformation (reverse) of the deformable intermediate portion 23 mentioned above certainly and effectively takes place, the packing device 20 is preferably provided with an annular thin portion 29 between the deformable intermediate portion 23 and the center seat portion 22. Namely, the deformable intermediate portion 23 and the center seat portion 22 are contiguous at the thin portion 29, as can be seen in FIGS. 4 and 5. Consequently, when the center seat portion 22 is depressed by an external force in the direction D (FIG. 5), the deformable intermediate portion 23 is easily bent and reverse-deformed with the help of the thin portion 29.

Figure 6:
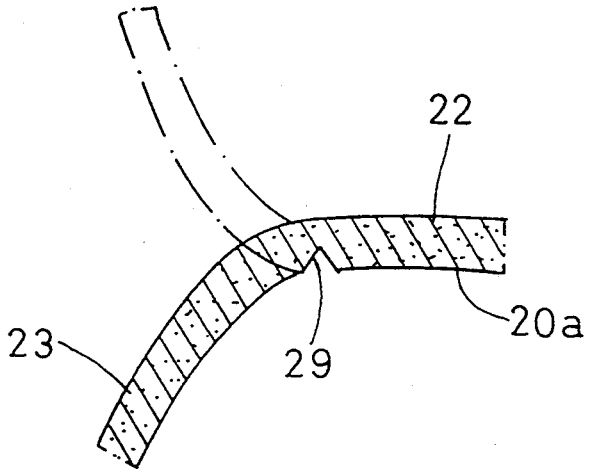
FIG. 6 is an enlarged sectional view of a circular thin portion at which a center seat portion and a curved deformable portion are contiguous.
Figure 7:
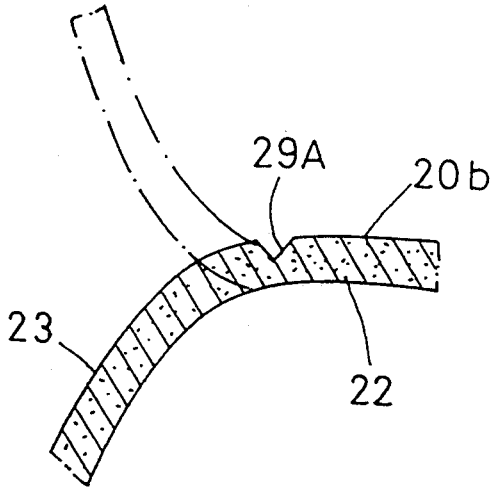
FIGS. 7 and 8 are enlarged sectional views of two different embodiments of a circular thin portion at which a center seat portion and a curved deformable portion are contiguous.
Figure 8:
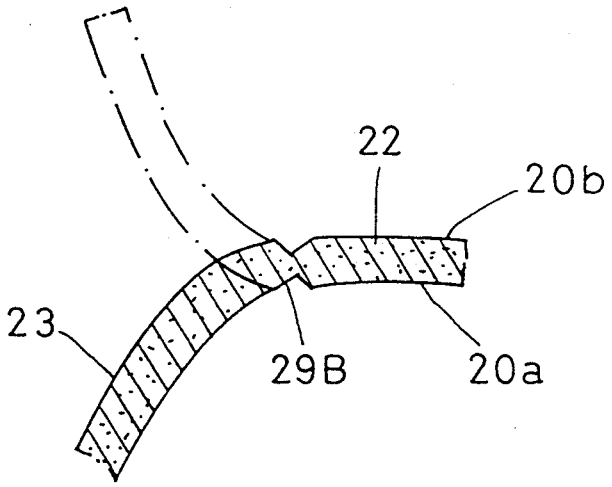

In FIG. 6, the thin portion 29 can be provided on the outer surface 20*a* of the packing device 20. Alternatively, it is also possible to provide the thin portion 29A or thin portions 29B on the inner surface 20*b* of the packing device 20 as shown in FIG. 7, or on both surfaces 20*a* and 20*b* thereof, as shown in FIG. 8, respectively.

The holding arms 24 extend integrally from the deformable intermediate portion 23 in the radial direction in the form of a petal of a flower. The number, shape, width and length of the holding arms 24 are appropriately determined depending on the shape and size of the object to be packed.

The holding arms 24 are preferably concave-curved with the front ends being curved upward so as to wrap the upper portion of the object to be packed when the packing device 20 is in the packed position (closed position). Namely, when the reverse deformation of the deformable intermediate portion 23 occurs, the holding arms 24 are substantially closed, so that the object to be packed can be entirely wrapped or covered by the packing device.

Each of the holding arms 24 is preferably provided with a reinforcing rib 27 extending along the length of the associated holding arm (radial direction). In addition to the reinforcement, the elongate ribs 27 enhance the shock absorbability at the side surface and upper portion of the object to be packed and contribute to the maintenance of the approximately constant temperature of the object when the packing device 20 is brought into the closed position. The elongate ribs 27 of the holding arms 24 can be connected to the corresponding ribs 26 of the deformable intermediate portion 23 mentioned above.

Figure 9:
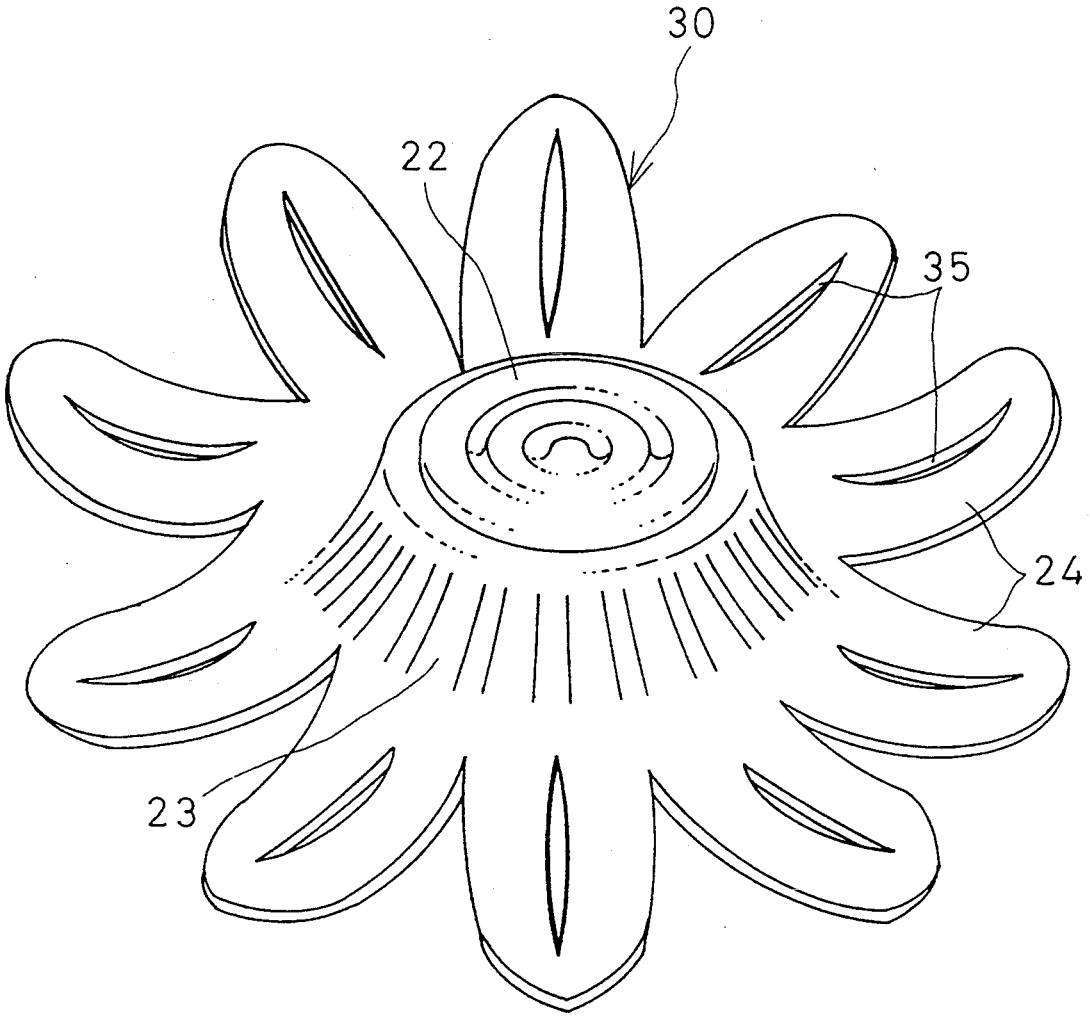
FIG. 9 is a perspective view of a packing device according to another embodiment of the present invention in which radially extending arms of a holding portion are provided with closed elongate openings.
Figure 10:
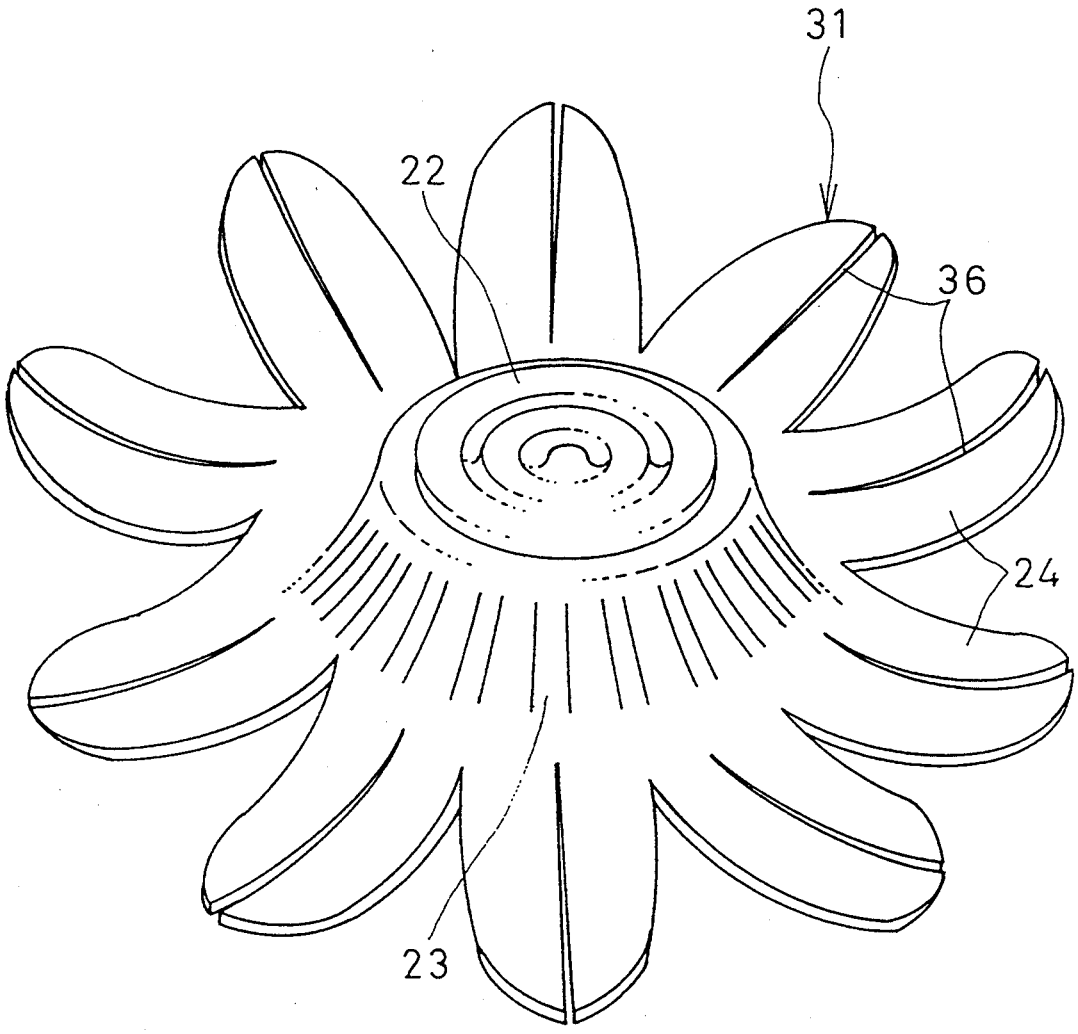
FIG. 10 is a perspective view of a packing device according to still another embodiment of the present invention in which radially extending arms of a holding portion are provided with slits.
Figure 11:
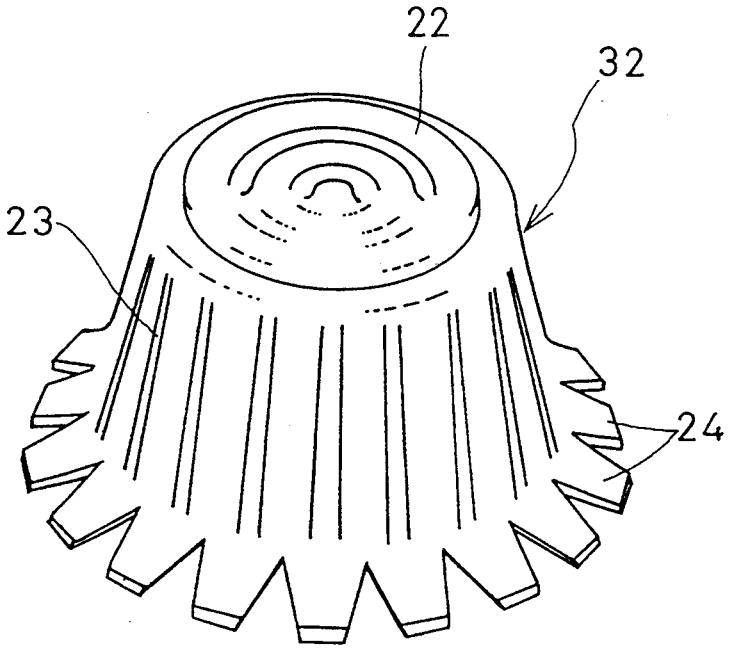
FIG. 11 is a perspective view of a packing device according to yet another embodiment of the present invention in which a holding portion is comprised of short radial arms.

FIGS. 9 through 11 show different embodiments of the present invention. In a modified embodiment shown in FIG. 9, the holding arms 24 of the packing device 30 are provided with elongated closed openings 35 which extend along the length of the respective holding arms 24. In another embodiment shown in FIG. 10, the holding arms 24 of the packing device 30 are provided with elongated slits 36 which extend along the length of the respective holding arms 24 and which have open ends. The elongated openings 35 (FIG. 9) or the elongated slits 36 (FIG. 10) ensure an easy deformation of the holding arms 24 so as to closely wrap the object to be packed in accordance with the shape thereof.

FIG. 11 shows still another embodiment of the present invention, in which the packing device 32 has relatively short holding arms 24. In this embodiment shown in FIG. 11, the object packed by the packing device 34 is exposed at the upper end portion of the object due to the short holding arms, in accordance with need.

In the modified embodiments of the packing device shown in FIGS. 9 through 11, the elements corresponding to those in the first embodiment shown in FIGS. 1 through 5 are designated with the same reference numerals.

The packing device according to the present invention can be manufactured by any known methods. A vacuum molding process per se known can be advantageously employed to inexpensively and easily produce the packing device. The following discussion will be addressed to the vacuum molding process with reference to FIGS. 12 through 14.

Figure 12:
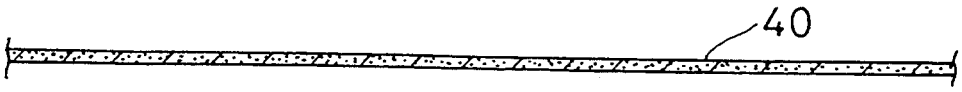
FIG. 12 is a sectional view of a sheet material of which a packing device according to the present invention is made.
Figure 13:
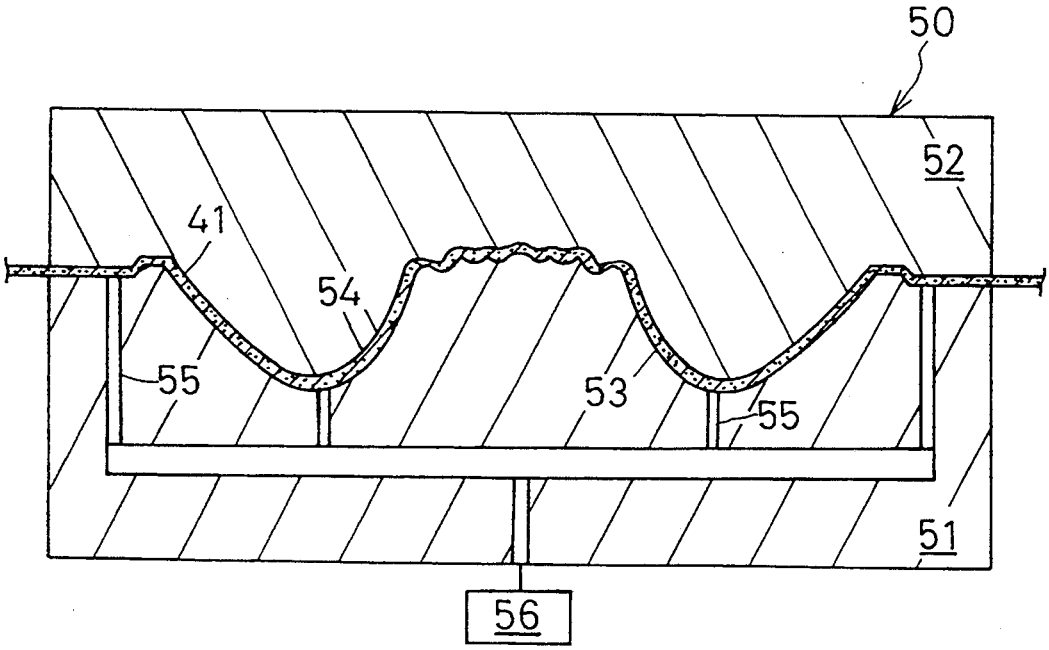
FIG. 13 is a sectional view of a vacuum molding die assembly which is used to make a packing device according to the present invention; and, FIG. 14 is a sectional view of a mold product produced by the use of a vacuum molding die assembly shown in FIG. 13.

FIG. 12 shows a sheet material 20 made of a synthetic resin foam, that is prepared by a known method. The sheet material 40 is then heated to be softened. The softened sheet material 40 is fed to a vacuum molding die unit 50. The vacuum molding die unit 50 is comprised of a lower die 51 and an upper die 52, as shown in FIG. 13. The lower and upper dies 51 and 52 have lower and upper die surfaces 53 and 54 which define therebetween a predetermined molding cavity corresponding to the center seat portion 22, the deformable intermediate portion 23 and the holding arms 24, respectively. The lower die 51 is provided therein with a plurality of vacuum suction holes 55 opening into the lower die surface 53. The vacuum suction holes 55 are connected to an external vacuum source 56 such as a vacuum pump, etc.

The softened sheet material 40 is placed on the lower die surface 53 of the lower die 51 and is sucked by vacuum through the vacuum holes 55, so that the sheet material 40 is deformed to come into close contact with the lower die surface 53. Thereafter, the upper die 52 is depressed to press the sheet material 40 by the upper die surface 54. Consequently, a predetermined shape of sheet 41 is obtained.

Figure 14:
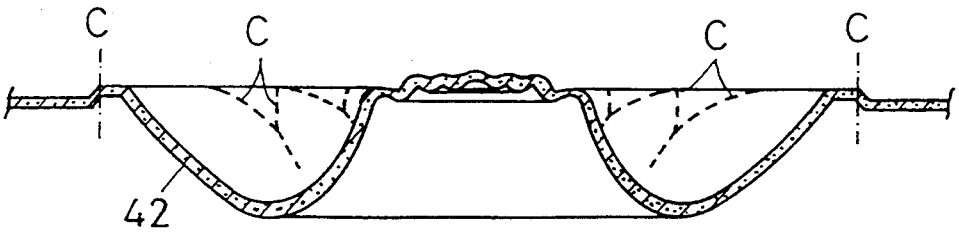

After that, the peripheral edge of the sheet 41 thus obtained is cut at cutting lines C (FIG. 13) for example by a press, so that a packing device 42 having a predetermined shape of holding arms can be produced, as shown in FIG. 14.

As can be understood from the above discussion, according to the present invention, the object, such as fruits, ornaments, daily necessaries, precision products, or other mechanical elements, etc., can be easily and simply packed or wrapped with the packing device merely by the reverse-deformation of the center seat portion of the packing device on which the object to be packed is put.

Consequently, no troublesome operation is necessary unlike the prior art, as mentioned above.

Furthermore, according to the present invention, the packing devices can be inexpensively and easily mass-produced by a vacuum molding process.

In addition to the foregoing, according to the present invention, the packing devices can be superimposed, and accordingly, not only is a large space for stock unnecessary, but also the packing devices are convenient for transport.

I claim:

1. A packing device which is made of a soft sheet material of foamed synthetic resin, comprising:

a raised center seat portion on which an object to be packed can be placed;

a reversible deformable intermediate portion integral at its inner end with an outer periphery of said center seat portion and diagonally extending downwardly from said raised center seat portion so that, when said raised center seat portion is depressed, said deformable intermediate portion is reversibly deformed in an upward opposite direction around said center seat portion and around said object being packed and placed thereon; and, a holding portion comprising a plurality of holding arms integral at an inner end with an outer periphery of said deformable intermediate portion and extending outwardly from said deformable intermediate portion in the radial direction of said intermediate portion and over said object being packed on said center seat portion.

2. A packing device according to claim 1, wherein said center seat portion is in the form of a generally circular plate.

3. A packing device according to claim 1, wherein said center seat portion is provided with at least one reinforcing rib.

4. A packing device according to claim 1, wherein said reversibly deformable intermediate portion is provided with radially extending reinforcing ribs.

5. A packing device according to claim 1, further comprising an annular thin portion between said raised center portion and said reversibly deformable intermediate portion.

6. A packing device according to claim 1, wherein said holding arms are curved into a concave shape.

7. A packing device according to claim 1, wherein said holding arms are provided with reinforcing elongate ribs extending in longitudinal directions thereof.

8. A packing device according to claim 1, wherein said holding arms are provided with elongate closed openings extending in longitudinal directions thereof.

9. A packing device according to claim 1, wherein said holding arms are provided with elongate slits extending in longitudinal directions thereof and having open ends.

10. A packing device made of a soft sheet comprising a raised center seat portion on which an object to be packed can be placed, an intermediate inclined portion integrally joined to and extending downwardly and radially from the periphery of said center seat portion and surrounding said center seat portion, said intermediate downwardly and radially inclined portion being reversibly deformable in the opposite direction from a downwardly inclined position into a closed position around an object when when said object is placed on said center seat portion and said center seat portion is depressed by an external force, and holding arms extending radially from said intermediate inclined portion so that, when said intermediate inclined portion is in said closed position, said holding arms are substantially closed to cover said object placed on said center seat portion.

* * * * *